United States Patent [19]

Womack et al.

[11] 4,073,978

[45] Feb. 14, 1978

[54] IMMERSION-TREATING TUBULAR ELEMENTS

[75] Inventors: William B. M. Womack; Ralph Emory Starnes, Jr., both of Carrollton, Ga.; John Charles Headrick, Oceola, Ark.; Ronald Ray Martin, Carrollton, Ga.

[73] Assignee: Southwire Company, Carrollton, Ga.

[21] Appl. No.: 741,529

[22] Filed: Nov. 12, 1976

[51] Int. Cl.[2] ..... B05D 1/18; B05D 1/38; B05D 3/12

[52] U.S. Cl. ..... 427/235; 118/56; 118/63; 118/73; 118/426; 118/603; 118/DIG. 12; 214/1 P; 427/230; 427/327; 427/345; 427/346; 427/348; 427/388 C; 427/435

[58] Field of Search ..... 118/423, 426, 73, 500, 118/603, 63, DIG. 10–DIG. 13; 134/104, 134; 214/1 P, 1 PB; 407/435, 310, 311, 230–235, 239, 318, 327, 346, 348, 299, 388, 345

[56] References Cited

U.S. PATENT DOCUMENTS

| | | | |
|---|---|---|---|
| 1,254,918 | 1/1918 | Machin | 118/426 |
| 1,789,596 | 1/1931 | Potthoff | 118/57 |
| 2,042,678 | 6/1936 | Miller | 118/DIG. 13 |
| 2,856,895 | 10/1958 | Anderson et al. | 118/426 X |
| 3,376,152 | 4/1968 | Okamoto et al. | 427/232 |
| 3,563,416 | 2/1971 | Dobrink | 134/134 |
| 3,861,409 | 1/1975 | Taniguchi | 134/134 |
| 3,946,125 | 3/1976 | Scheiber | 118/DIG. 10 |
| 3,978,816 | 9/1976 | Saloom | 118/426 |

FOREIGN PATENT DOCUMENTS

| | | | |
|---|---|---|---|
| 10,866 | 3/1956 | Germany | 118/426 |

*Primary Examiner*—Morris Kaplan

*Attorney, Agent, or Firm*—Herbert M. Hanegan; Stanley L. Tate; Robert S. Linne

[57] ABSTRACT

A method of and apparatus for the immersion treatment of discrete lengths of galvanized conduit to inhibit the formation of "white rust" on the conduit surfaces are disclosed. The conduit is continually conveyed successively through three treatment zones comprising a cleaning bath containing a cleaning agent which removes lubricating oils, greases, dirt and the like from the conduit interior and exterior surfaces, a rinse bath and a coating bath containing a coating agent including chromate ions and a polymeric coating composition. A rotary star wheel-type conveyor is arranged in each treatment zone for transporting the conduits in spaced, substantially parallel relation to each other about an arcuate path through each bath and for inclining the conduit above the bath for a time effective to drain excess liquid from the interior and exterior conduit surfaces. Effective draining of excess liquid prior to entry to another zone minimizes contamination of the various baths and yields a high quality product.

33 Claims, 7 Drawing Figures

FIG. 3
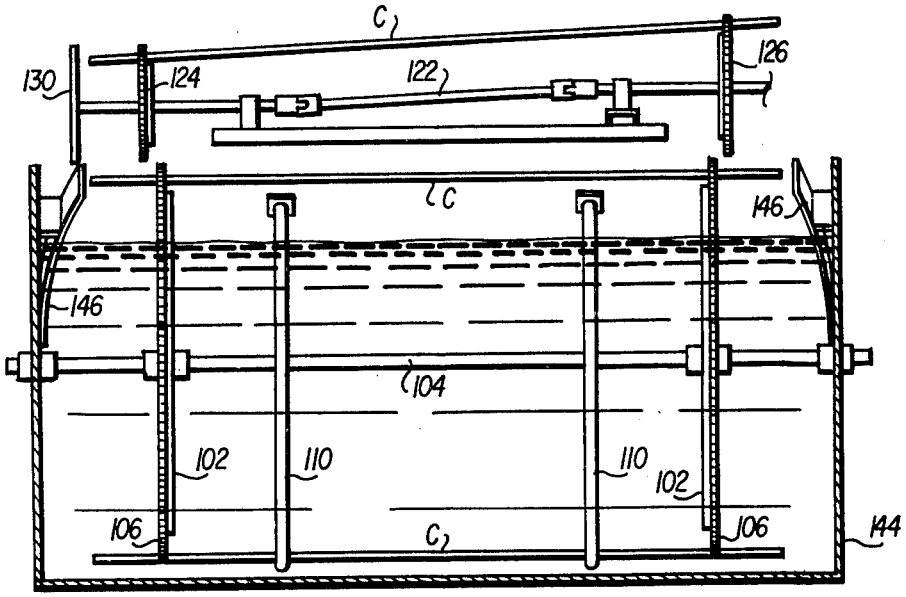
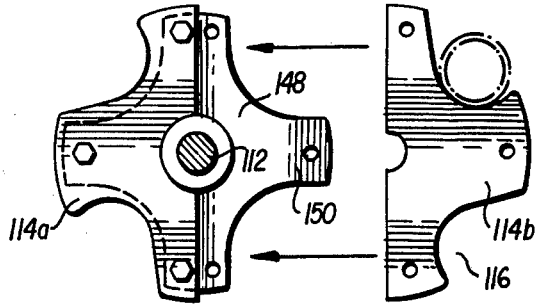
FIG. 4
FIG. 5
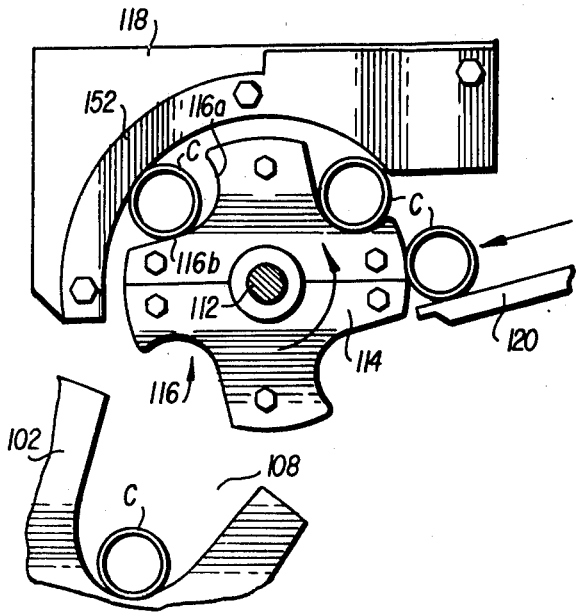

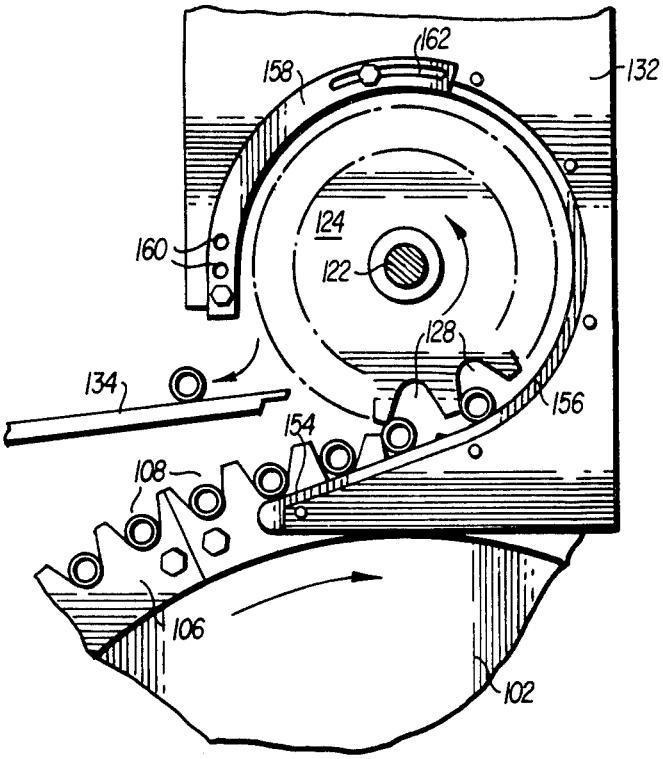
FIG. 6
FIG. 7
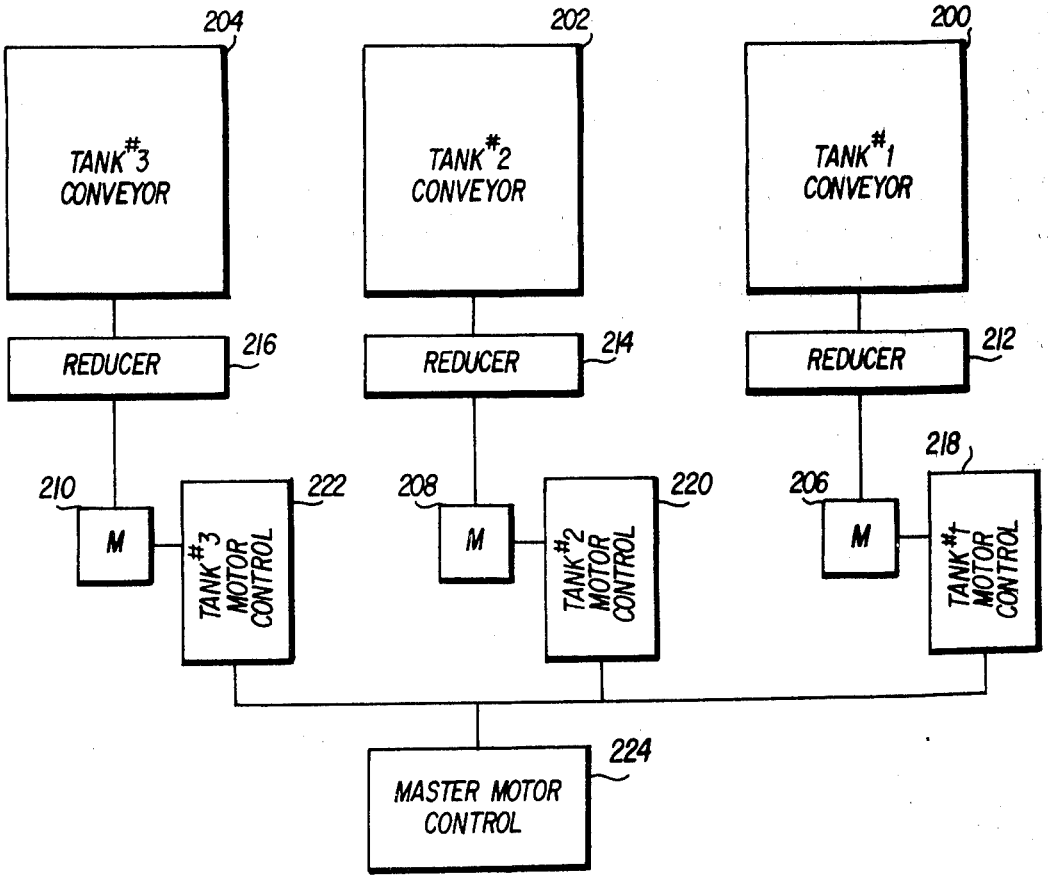

IMMERSION-TREATING TUBULAR ELEMENTS

BACKGROUND OF THE INVENTION

The present invention relates generally to an improved method of treating tubular elements and more particularly for cleaning and coating the surfaces of galvanized conduit to inhibit the formation of zinc oxide or "white rust".

In one technique for the continuous fabrication of galvanized steel conduit of a discrete length from galvanized steel strip, the strip is fed continuously in succession through (1) a tube forming mill where it is shaped into a continuous tubular element with the edges of the strip in abutting relation, (2) a welding machine where the abutting edges of the continuously formed tube are welded together to form a welded seam longitudinally of the tube, (3) a spray metallizing apparatus in which a zinc coating, which may include aluminum and/or aluminum alloys, is applied in spray form over the welded seam where the galvanized coating was volatilized by the seam welding operation, and (4) a tube cut-off machine which severs the continuous tube into discrete lengths which are thereafter accumulated for subsequent processing and/or bundling. U.S. Patent Application Ser. No. 667,066 filed Mar. 15, 1976 for Galvanized Tube Welded Seam Repair Metallizing Process and assigned to the assignee of this invention, describes a continuous method for fabricating galvanized steel conduit from galvanized steel strip, as aforementioned, the disclosure of which is incorporated herein by reference.

Zinc coated steel conduit, hereinafter referred to as galvanized conduit, is subject to corrosion or "white rust" by prolonged exposure of the conduit to the atmosphere, high humidity, salt spray or other oxidizing environments. Continued oxidation of the zinc protective coating can also lead to oxidation and deterioration of the underlying steel base.

Thus, various processes for protecting galvanized conduit using paints, oxide inhibitors and the like have been suggested. However, such conventional techniques are not totally efficient and rely on manual or non-automatically performed coating steps, for example, loading the conduits into slings for batch dipping, or dip coating individual conduits. Such techniques are unsuitable for handling quantities of galvanized conduit produced with the earlier referred to high speed, continuous production line techniques. To maintain both quality and productivity, the coating operation must be substantially fully automated and capable of being performed at a speed at least equal to that of the tube forming mill.

Immersion coating has been found to be effective where both outside and inside surfaces of the conduit are to be protected. However, immersion coating techniques are not altogether free of difficulties, especially where high production is required. One of the more serious problems is the carry-over of liquid from one treatment stage to another. Because of chemical incompatibilities, the unwanted mixing of chemicals causes premature breakdown of the chemicals and/or undesired reactions requiring frequent replenishment and even replacement. Since the coating agents and precoating treatment agents are expensive and require care in disposal due to new environmental pollution regulations, there is a need to minimize liquid carry-over during transfer of the conduit from stage to stage. This need is further compounded where high productivity is involved.

A search of the prior art failed to uncover prior patents which disclosed the method and apparatus of the present invention. Various patents were uncovered which disclose immersion coating techniques generally, to wit:

U.S. Pat. No. 1,521,010
U.S. Pat. No. 1,570,949
U.S. Pat. No. 1,789,596
U.S. Pat. No. 2,114,974
U.S. Pat. No. 2,257,740
U.S. Pat. No. 2,701,546
U.S. Pat. No. 2,718,474
U.S. Pat. No. 2,804,841
U.S. Pat. No. 2,818,044
U.S. Pat. No. 2,906,238
U.S. Pat. No. 2,951,491
U.S. Pat. No. 3,030,226
U.S. Pat. No. 3,978,816

SUMMARY AND OBJECTS OF THE INVENTION

In view of the foregoing, it should be apparent that there still exists a need for an improved process and apparatus for treating the surfaces of galvanized conduit to inhibit the formation of white rust. It is, therefore, a primary objective of the present invention to fulfill this need by providing an improved immersion process for treating galvanized conduit from a high-speed tube forming mill.

Another object of this invention is to provide a method for continually conveying discrete lengths of galvanized conduit successively through a series of baths, i.e., cleaning bath, rinse bath and coating bath, with a minimum of liquid carry-over between successive baths.

Still another object of this invention is to provide a method of closely controlling the operating parameters, e.g., pH, concentration, temperature, etc. of the different baths used for cleaning, rinsing and coating discrete lengths of galvanized conduit being treated to yield a fully protected conduit at low cost.

Still another object of this invention is to provide a method of applying a corrosion protective coating to galvanized steel conduit in a manner which minimizes the ecological problems associated with the disposal of waste solutions.

Still another object of this invention is to provide a process for conveying galvanized conduit through a plurality of bath solutions by means of selectively independently or synchronously controlled star wheel conveyor systems.

Yet another object of this invention is to provide a process for conveying galvanized conduit through a bath which apparatus maintains positive control of individual conduits from bath inlet to bath outlet and which provides maximum drainage time for solutions remaining in the interior of the conduits emerging from the bath.

Broadly described, these and other objects of the invention are accomplished in accordance with its method aspects by continually subjecting discrete lengths of galvanized conduit produced by a high-speed tube forming mill to a plurality of separate immersion treatment zones employing aqueous containing treating solutions in a manner designed to effectively clean and protect the interior and exterior surfaces against corrosion while at the same time preserving the chemical integrity of the various treating agents employed.

The method according to the present invention can be described as a method for continually treating the interior and exterior surfaces of tubular elements, comprising the steps of:

providing a first bath containing a cleaning agent, a second bath containing a rinse agent, and a third bath containing a coating agent;

conveying the tubular elements in spaced, substantially parallel relation to each other about a first arcuate path through each bath in a first rotational direction for a predetermined immersion time;

conveying the tubular elements emerging from each bath about a second arcuate path disposed above each bath in a second rotational direction opposite to the first rotational direction; and simultaneously inclining the tubular elements in the second arcuate path, the inclination of the tubular elements and the path traveled by the tubular elements about the second arcuate path being effective to drain excess agent from the tubular elements.

Continuously produced galvanized conduit formed in a tube mill from galvanized steel strip is generally cut into convenient lengths, e.g., ten foot lengths, for further processing. To assure compliance with industry-wide standards, each length of galvanized conduit must be protectively coated or otherwise passivated to inhibit the formation of zinc oxide or white rust on the conduit surfaces. The interior and exterior surfaces of galvanized conduit issuing from the tube forming mill and tube cut-off apparatus are covered with lubricating oil or coolant used in the tube forming apparatus, and frequently with dirt, grease, waxes and the like. These substances must be thoroughly cleaned from the conduit prior to the application of a protective coating. Even if wiping means, such as an air blast is used downstream of the tube forming mill, substantial amounts of lubricating oil and the like will remain on the conduit surfaces and, unless removed, will prevent proper chemical reaction of the protective coating with the galvanized conduit. Thus, it is essential that each conduit be subjected to a cleaning step to dissolve or otherwise remove the aforementioned contaminants prior to application of the coating.

In accordance with one aspect of the method of the present invention, initial cleaning of the galvanized conduit is accomplished by immersing the individual conduits for a predetermined time along an arcuate path in an alkaline cleaning solution which preferably contains a biodegradable surfactant. Selection of a suitable cleaning solution will depend on such factors as its effectiveness with respect to the tube mill coolant and/or lubricant, its compatibility with the remaining treating agents, its corrosiveness and the like.

After immersion in the cleaning solution bath, each conduit emerging from the bath is retained directly above the bath in a position inclined to the horizontal for a sufficient period of time to permit the excess solution to drain from the exterior and interior conduit surfaces before the conduit is conveyed to the next treatment zone. This procedure not only minimizes carry-over into successive treatment zones, but also reduces the frequency of addition of make-up cleaning solution.

The cleaned conduit is thereafter conveyed by gravity to a rinse bath where, prior to being positively engaged by the rinse tank conveyor, it may be subjected to an air blast directed through its hollow interior to minimize still further the extent to which residual cleaning solution is carried over into the rinse bath. The rinse bath according to the invention is preferably fresh hot water. The conduit is conveyed through the rinse water and upon emerging from the rinse water is drained, gravity conveyed and subjected to an air blast, all in a manner substantially identical to that of the procedure used in the cleaning tank.

After the rinsing step, each conduit is individually engaged by the coating tank conveyor and immersed in the coating solution for a controlled time period, drained by inclining the conduit from the horizontal, conveyed by gravity to an air blast station where the conduit interior is subjected to pressurized air also in the manner as previously described with respect to the cleaning and rinse treatments. The coating solution is preferably an aqueous, alkaline solution containing a chromium compound and a soluble polymeric material. Such a coating on the galvanized surfaces of the conduit, when applied according to the invention, has been found to provide effective corrosion-inhibiting characteristics. The conduit surface is thus provided with a transparent thin-film abrasion resistant coating in addition to the chromate protection. Optionally, a colorant may also be added to the coating solution to enhance the luster of the underlying zinc coating.

It has been found according to the invention that effective draining of excess cleaning, rinsing and coating agents can be achieved by conveying the conduits about an arcuate path at an inclination beginning from the horizontal and gradually increasing to a maximum inclination of about 1 inch per foot of conduit length and then decreasing to approximately the horizontal, the time of inclination being at least about 12 seconds.

Because the effectiveness of the coating is dependent to a large extent on the temperature, concentration, pH and non-volatile content of the coating solution, these parameters are carefully controlled either automatically or semi-automatically by frequent testing and correction. In the case of temperature and pH, automatic control systems are provided as will be described in greater detail hereinbelow.

If desired, drying apparatus, such as forced hot air blowers, infra-red lamps or the like, may be arranged downstream of each treatment zone to accelerate evaporation and/or drying of residual solution on the exterior conduit surfaces.

By way of example only and not limitation, the following treating agents have been employed in the method of this invention and found to be compatible with each other and with lubricants or the like entering the system with the galvanized conduit from the tube mill. The resulting coated article has been found to provide superior protection against "white rust" formation.

1. Tube mill coolant — HOCUT 702, a water-soluble synthetic coolant manufactured by E. F. Houghton and Company, Carrollton, Georgia;
2. Cleaning solution -SPRAY NINE, a biodegradable solution of non-ionic surfactants and builders manufactured by Knight Oil Company, Johnstown, New York;
3. Rinse solution — Fresh water; and
4. Coating solution - BALLGAL G-1405, an aqueous, alkaline solution comprising chromium compounds and a polymeric resins composition, manufactured by the Ball Chemical Company, Glenshaw, Pennsylvania.

The apparatus to effect the method aspects of the invention are accomplished by providing three sequentially arranged treatment tanks containing, respectively, cleaning, rinsing and coating agents. Each tank has a rotary conveyor system for immersing the conduits in the tank solution for a controlled residence time and for maintaining positive control of individual conduits with a minimum of physical contact between each conduit and between the conduit and the rotary conveyor components. Apart from the contact between conduits, other metal-to-metal contact is also substantially eliminated throughout the entire treatment system by coating or lining all conduit-contacting surfaces with or by fabricating them of a polymeric material, such as polyethelene, polypropylene, polyamide, polytetrafluoroethylene, or the like.

Each rotary conveyor comprises a pair of large diameter immersion star wheels axially spaced along a horizontal shaft extending through journal bearings in opposite walls of the tank and rotatably driven by a prime mover mounted externally of the tank. The periphery of each star wheel is provided with a detachable ring or ring sections made of polymeric material and having a plurality of radial outwardly-opening, equiangularly spaced notches for receiving and conveying individual horizontally-oriented conduits in an arcuate path downwardly and then upwardly through the treatment agent. Cooperating with the immersion star wheels is a pair of smaller retrieval star wheels each having a different diameter, the lowermost tangents of these diameters being arranged to lie in a common horizontal plane.

The retrieval star wheels are rotatably supported in superposed relation to the immersion star wheels to pick up the emerging conduits from the peripheral notches of the immersion star wheels and rotate them about an arcuate path in a direction opposite to the rotational direction of the immersion star wheels. This arrangement, comprising different diameter retrieval starwheels and the arcuate path traveled by the conduit above the bath solution, inclines the emerging conduit at an angle from the horizontal and prolongs the dwell time of the conduit above the tank to effectively drain excess solution from each conduit and return the excess to its respective bath. Thus, solution carry-over into successive baths and solution make-up requirements are advantageously minimized. To assure maximum operational flexibility of the system, the rotary conveyors are operable either independently of or simultaneously with each other and means are provided between successive tanks for accumulating a plurality of individual conduits. The system is also capable of accommodating a wide range of conduit diameters with a miniumum of adjustment of the conveyor structure.

Any residual cleaning agent or rinse agent remaining on the interior and exterior surfaces of the conduits departing the retrieval star wheels is removed by a combination of evaporative drying means and an air blast directed through the hollow interior of the conduit. Similarly, the film-forming polymer is dried and the solvent therefor evaporated by a drying/evaporating means and excess coating solution is blown from the conduit interior by an air blast.

With these and other objects, advantages and features of the invention that may become hereinafter apparent, the nature of the invention may be more clearly understood by reference to the following detailed description of the invention, the appended claims and to the several views illustrated in the attached drawings.

BRIEF DESCRIPTION OF THE DRAWINGS

FIG. 3 is a cross-sectional end view of one of the treatment tanks of the invention;

FIGS. 4 – 6 are side elevation views showing various details of the rotary conveyor system according to the invention; and FIG. 7 is a schematic view showing the control system for the conveyor drives.

DETAILED DESCRIPTION OF A PREFERRED EMBODIMENT

Figure 1:
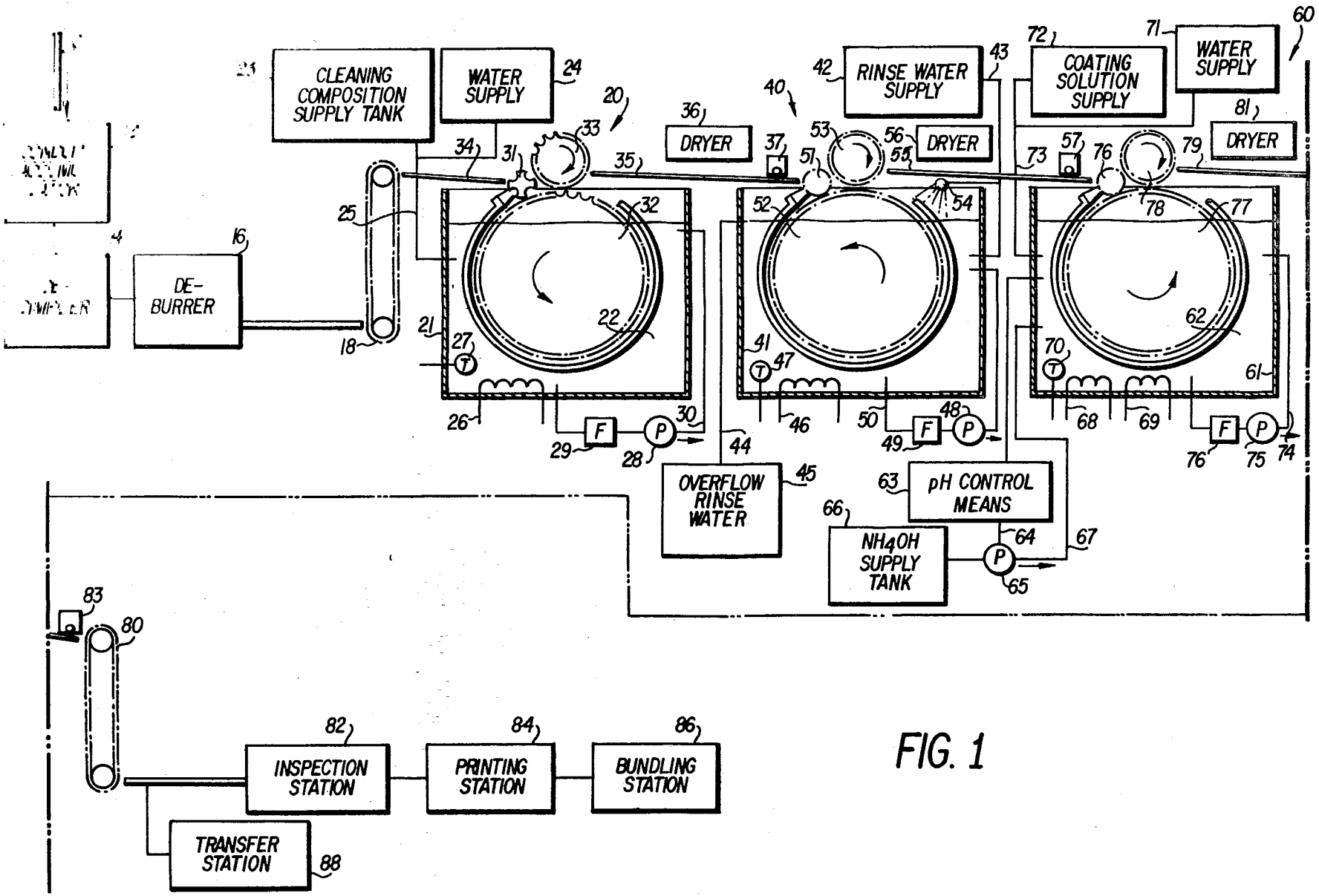
FIG. 1 is a schematic view of the treatment system of the present invention.

Referring now in detail to the drawings and in particular to FIG. 1, wherein the galvanized conduit treatment system according to the present invention is schematically illustrated, discrete lengths of galvanized conduit C issuing, for example, from the tube cut-off machine of a non-illustrated tube forming mill are conveyed, usually by a magnetic roll conveyor to an accumulator 12. From accumulator 12, the conduit C is transferred to a conventional end dedimpler 14 and deburrer 16 and thence to a vertical "up" chain conveyor 18 located adjacent the input to the three treatment zones of the system, comprising a cleaning zone 20, a rinse zone 40 and a coating zone 60.

After passing through the three treatment zones, 20, 40, 60, the conduits are individually fed by a vertical "down" chain conveyor 80 either (1) to a conduit processing line including a quality inspection station 82, a printing staton 84 and a bundling station 86 where the finished conduits are bundled together for storage and/or shipment or (2) to a transfer station 88 where the coated conduits may be removed for further processsing, such as, for example, threading of the conduit ends and corrosion inhibiting treatment of the threaded conduit ends.

Referring now to the individual treatment zones, cleaning zone 20 includes an open tank 21 which, in the described embodiment, has a volumetric capacity of about 5,000 gallons. It will be understood that the size of the tank and auxillary equipment can be varied depending on a desired capacity or throughput of conduit. Tank 21 contains approximately 4500 gallons of cleaning agent 22, the pH and concentration of which are controlled by addition of either cleaning composition or water from a cleaning composition supply tank 23 and a water supply 24 respectively via a supply line 25. The cleaning agent concentration is determined by periodic refractometer measurements and is adjusted according to well-known procedures. Heating means 26 is provided to maintain the temperature of the cleaning solution within a predetermined range and is automatically controlled by a temperature sensor 27 connected to a conventional, and, therefore not particularly illustrated temperature control system. While steam heating is preferred, any other suitable heating medium could be employed. The cleaning solution in tank 21 is constantly recirculated and filtered during operation of the system by a pump 28 and a filter 29 through a line 30 to assure uniform mixing of the solution and to remove therefrom metal fines, soil, dirt and other particulate contaminants carried over from the downstream operations on the conduit.

As previously mentioned, one cleaning agent which has been found particularly suitable for use in the present method is Knight'2 SPRAY NINE. Table I below sets forth the working ranges and preferred operating conditions, including conduit immersion times, for a cleaning solution which utilizes SPRAY NINE as a cleaning agent.

TABLE I

| Parameter | Normal Working Range | Preferred |
|---|---|---|
| Concentration (Water: cleaning agent) | 2:1 to 1:2 | 1:1 |
| pH | In excess of 9 | 10.5 - 11.5 |
| Temperature | 40° F to 90° F | 70° F to 80° F |
| Immersion time (Minutes) | 0.5 to 5 | 1 to 3 |

Arranged transversely of tank 21 is a star wheel-type conveyor apparatus having a plurality of synchronously operated star wheel pairs comprising input star wheels 31, immersion star wheels 32 and retrieval star wheels 33. Input star wheels 31 individually engage conduits C conveyed by gravity from chain conveyor 18 down inclined guideway 34, rotate the conduits clockwise as viewed in FIG. 1 and discharge them into peripheral notches on the immersion star wheels 32. The immersion star wheels 32 rotate the conduits counterclockwise in an arcuate path downwardly and then upwardly through the cleaning solution 22 for a controlled immersion time. Conduits emerging from the cleaning solution are picked up from the immersion star wheels 32 by the retrieval star wheels 33 which convey the conduits in a clockwise direction about an arcuate path above tank 21 and simultaneously incline the conduits to drain excess cleaning solution therefrom and back into tank 21. The extent of inclination and the arcuate path length traveled by the conduits about retrieval star wheels 33 is effective to drain the excess solution from both the interior and exterior surfaces of the conduits. From retrieval star wheels 33, the conduits are transferred to an inclined guideway 35 where any residual cleaning solution on the exterior conduit surfaces is evaporated by a dryer 36 which may be, for example, a forced hot air blower, infra-red lamps or the like. Solution retained in the interior of the conduit is removed by an air blast nozzle 37 arranged near the upstream end of guideway 35, collected and drained back into tank 21.

Rinse zone 40 includes an open tank 41 having a volumetric capacity and working volume approximately the same as tank 21. Tank 41 contains fresh water continuously supplied from a rinse water supply 42 via a supply line 43 at an overflow rate of between 2 and 5 gallons per minute, depending on the operational speed of the system. Overflow water flows through an overflow line 44 into a rinse water sump 45 from which it may be either dumped into sewage or treated and reused. If overflowed at the above rate, the pH of the rinse water should remain between the preferred range of about 7.0 to about 9.0 . It will be appreciated that the rinse bath could have little, if any, overflow, if desired. Under such conditions the rinse water pH would be controlled by periodically dumping a portion of the tank and adding fresh water. Heating means 46, such as a steam heating system, is provided to maintain the rinse water temperature within the desired range and is automatically controlled by temperature sensor 47 in a manner similar to the temperature control system of tank 21. The rinse water is also continuously recirculated and filtered to remove particulate matter by a pump 48 and filter 49 through line 50.

Table II below sets forth the working range and preferred operating conditions for the rinse water in tank 41.

TABLE II

| Parameter | Normal Working Range | Preferred |
|---|---|---|
| pH | About 7.0 or above | 7.0 to 9.0 |
| Temperature | 40° F to 200° F | 160° F to 180° F |
| Immersion time (Minutes) | 0.5 to 5 | 1 to 3 |
| Overflow rate (Gal/min) | 0 to 10 | 2 to 5 |

A rotary star wheel-type conveyor substantially identical in operation to that of cleaning tank 21 is provided in rinse tank 41 for picking up individual conduits from guideway 35 and conveying the same through the rinse water and includes input star wheels 51, immersion star wheels 52 and retrieval star wheels 53. As each conduit emerges from the rinse water, it is sprayed along its entire length by means of a transversely arranged spray header 54 which may be connected to water supply line 43 as shown in FIG. 1 or which may be supplied with hot rinse water from tank 41.

Conduits discharged from retrieval star wheels 53 are conveyed by gravity along inclined guideway 55 past an evaporative dryer 56 to air blast nozzle 57 for removal of residual water from the conduit surfaces, the interior residual water being collected and drained back into tank 41.

Coating zone 60 includes an open tank 61 also having a volumetric capacity and working level approximately the same as tank 21. Tank 61 contains a corrosion-inhibiting coating agent 62, preferably an aqueous solution comprising chromate ions and a film forming polymer, such as the aforementioned BALLGAL G-1405 coating composition. To achieve an effective corrosion-inhibiting coating on the galvanized conduit and to protect the coating solution from irreversible chemical reactions caused by over-temperature conditions, the pH, concentration, temperature and non-volatile content of the coating solution must be carefully controlled. Solution pH is automatically controlled by a pH control means 63 which includes a conventional pH measuring device with means for sending a common signal via electrical connection 64 to a pump 65 which, in turn, pumps a suitable liquid, such as ammonium hydroxide, from supply tank 66 into tank 61, via a line 67. If the solution pH falls below a predetermined minimum value, for example, by evaporation of the ammonia in the coating solution, by dilution or by contamination with acids or other electrolytes, precipitation of the soluble polymer or nonvolatiles will occur, resulting in a poor quality coating on the conduit. Addition of ammonium hydroxide by the above described automatic pH controller maintains the pH at the desired range.

Proper temperature control is provided by heating means 68 and cooling means 69, both of which are controlled by a temperature control system (not shown) in response to solution temperature as measured by a temperature sensor 70.

The concentration of the coating solution is controlled by addition of either water or coating solution from water supply tank 71 or coating solution supply tank 72 respectively via a line 73. Concentration is determined by periodic refractometer measurements of the tank solution and adjusted according to known procedures. To assure a high quality coating, it is important that, when adjusting the coating solution concentration, the non-volatile content of the total volume of coating solution in tank 61 is maintained above a required minimum percentage by weight. Thus, prior to adjusting the concentration by adding either water or coating solution, the effect thereof should be determined by evaporation testing of the coating solution in the tank and the coating solution to be added, if any, and the expected non-volatile content of the tank solution calculated.

The cleaning solution is preferably periodically circulated through tank 61 via line 74 by pump 75 and filtered by filter 76, preferably at least once daily for about 20–30 minutes during system shut-down or prior to placing the system in operation.

The following Table III sets forth the operating conditions of the BALLGAL coating solution contained in tank 61.

TABLE III

| Parameters | Normal Working Range | Preferred |
|---|---|---|
| Coating solution non-volatile content | .7% to 1.9% | 1.2% by weight* |
| pH | 7.8 to 10.0 | 8.5 to 9.0 |
| Temperature | 100° F to 140° F | 110° F to 135° F |
| Immersion time (minutes) | 0.5 to 5 | 1 to 3 |

*Typically, BALLGAL G-1405 is available as a concentrate with a minimum non-volatile content of about 5.8% by weight and is diluted with water (4:1 water to BALLGAL G-1405) to yield a non-volatile content of about 1.2% by weight of the coating solution. However, the working solution may be varied depending on the desired coating thickness.

Cleaning tank 61 is provided with a rotary star wheel-type conduit conveyor like that of tanks 21 and 41, including input star wheels 76, immersion star wheels 77 and retrieval star wheels 78. Coated conduits are transferred from the star wheels 78 to inclined guideway 79 above which is located a dryer 81 for drying the polymer film coating on the exterior conduit surfaces and for evaporating any residual solution volatiles remaining thereon. Air blast nozzle 83 removes residual solution retained in the conduit interior, which solution is drained back into tank 61.

From the foregoing discussion, it will be appreciated that the method for cleaning and coating discrete lengths of galvanized conduit according to the present invention provides an improved process for handling the output of a high-speed tube forming mill. An immersion star wheel 77 can accommodate 64-10 foot long conduits having a diameter of between ½ inch to 2 inches and, operating at a rotational speed of 1 RPM. The system is capable of handling a tube mill output of about 600 feet per minute within the normal working ranges listed above in Tables I, II and III. Furthermore, the method is advantageously achieved with minimal adverse effects on the operating conditions by substantially eliminating any carry-over of treating agents between successive treating zones.

Figure 2:
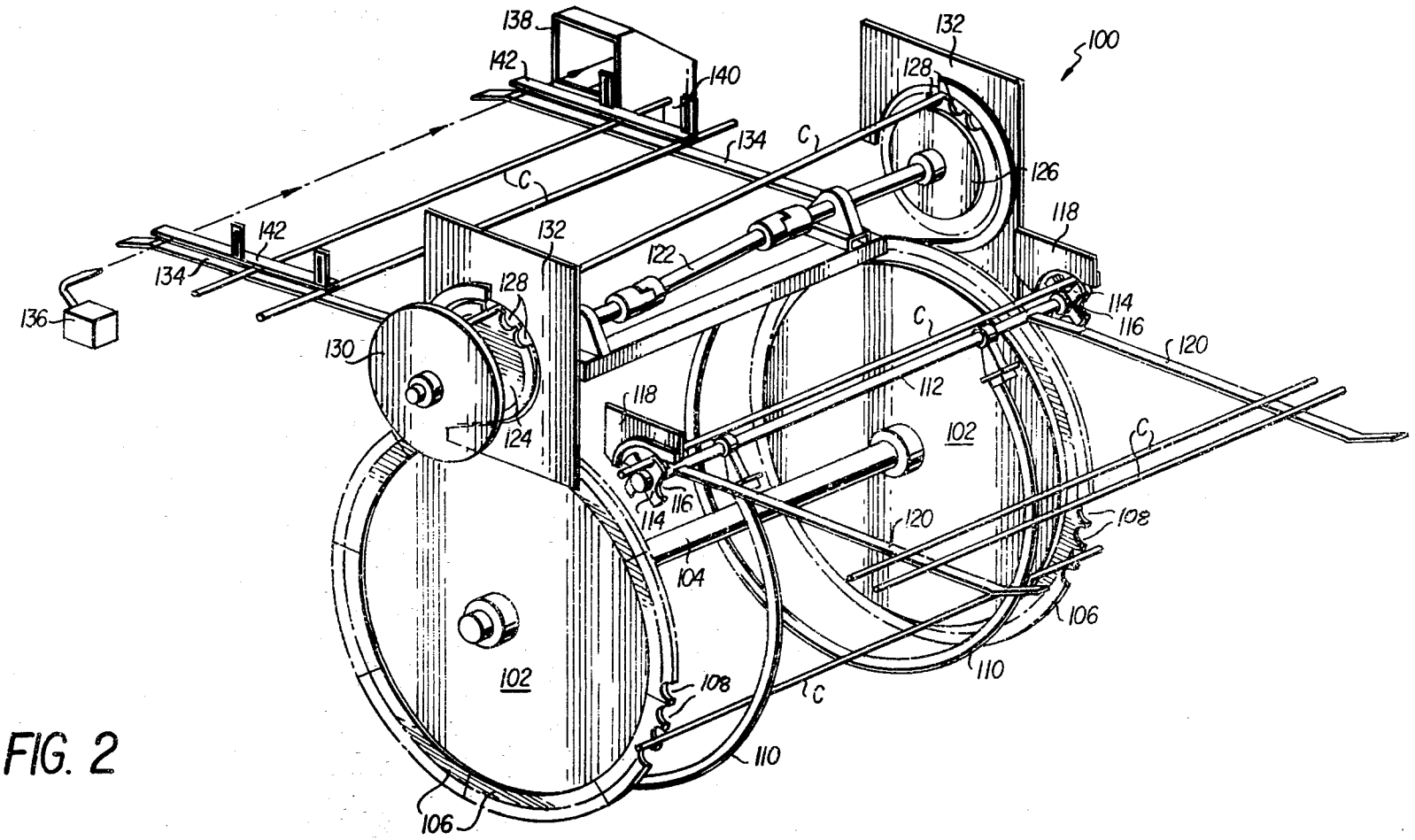
FIG. 2 is a perspective view illustrating the arrangement of the rotary conveyor system of the invention.

Describing now the apparatus according to the present invention, there is depicted in FIG. 2 a view of a rotary star wheel conveyor 100 for conveying discrete lengths of conduit C and which, for purposes of clarity, has been illustrated without details of the treatment tank and conveyor support framework. Only one conveyor will be described since all the treatment zones are provided with substantially identical conveyor apparatus. The conveyor system 100 comprises a pair of large immersion star wheels 102 affixed in axially spaced relation to each other on a horizontal shaft 104 which is journaled in sealed bearings through opposite walls of a treatment tank. A prime mover and reduction gear box (FIG. 7) are drivingly connected to the shaft exteriorly of the tank. About the periphery of each star wheel 102, there are secured arcuate ring segments 106 in the outer periphery of which are formed radial conduit-receiving notches 108. The segments 106 are formed of a polymer material, such as polyethylene or the like, to minimize abrasive metal-to-metal contact between the conveyor apparatus and the individual conduits.

Cooperating with the star wheels 102 are a pair of arcuate guide members 110 of generally cylindrical cross-section which serve to retain the conduits in the star wheel notches 108 as they are fed downwardly and then upwardly through the treatment bath. The inside radius of the arc formed by each guide member 110 is slightly greater than the radius of each star wheel 102 as defined by the outermost tips of the notched segments 106. The guide members 110 are preferably polymer-coated metal tubes but may be formed of tubular polymer material if desired. By reason of the cylindrical cross-section of the guide members 110 and the cylindrical cross-section of the conduit, an essentially point contact is maintained therebetween at any instant in time during immersion of the conduit in the bath solution. This feature, combined with the relatively loose-fitting, but positive engagement of each conduit in the notches 108, assures minimum abrasion of the conduit and maximum contact between bath solution and the conduit surfaces.

Mounted in axially spaced relation on a shaft 112 adjacent to and slightly above the downstream side of the star wheels 102 are a pair of small input star wheels 114 each of which is provided with four peripheral notches 116. The input star wheels 114 function to pick up individual conduits to be treated, convey them in a counterclockwise arcuate path and dischargwe them one-by-one into the notches 108 of rotating star wheels 102. Above each star wheel 114 is mounted an adjustable guide 118 for retaining the conduit in notches 116 as they are rotated. Conduits are fed by gravity to the input star wheels 114 from the downstream side of the apparatus 100, e.g., from a downstream treatment tank 21 or 41 or from chain conveyor 18 (FIG. 1), by inclined guideways 120.

Directly above the immersion star wheels 102, there is mounted, on an articulated shaft 122, a pair of retrieval star wheels 124, 126 each having an equal number of radial conduit-engaging notches 128. Star wheels 124, 126 serve to retrieve the conduits from the notches 108 of star wheels 102 as the conduits emerge from the treatment bath and to incline them from the horizontal to permit drainage of excess liquid therefrom in a manner to be hereinafter described. The outside diameter of star wheel 124 is smaller than the diameter of star wheel 26 by a predetermined amount and the rotational axes of the retrieval star wheels are vertically spaced from each other a distance equal to half the difference between the respective star wheel diameters such that the lowermost tangents to their peripheries lie in a common horizontal plane. The star wheels 124, 126 are rotated in a counterclockwise direction as viewed in FIG. 2 at a speed synchronized with that of star wheels 102. This arrangement permits the star wheels 124, 126 to retrieve individual conduits from star wheels 102 while the conduits are disposed in a substantially horizontal orientation, rotate them in a counterclockwise arcuate path above the bath and simultaneously incline them to drain excess liquid from both the interior and exterior surfaces of the conduit. As the conduit travels upwardly about the arcuate path defined by star wheels 124, 126, the inclination thereof from the horizontal gradually increases to maximum at the uppermost point on the retrieval star wheels and then diminishes during the downward travel along the arcuate path until the conduit is discharged from the retrieval star wheels at a slight inclination to the horizontal. Excess liquid draining from the lowermost ends of the conduits is deflected back into the bath by a circular plate 130 mounted on shaft 122 outwardly of the star wheel 124.

A guide plate 132 is provided about each retrieval star wheel 124, 126 in a slight radially spaced relation thereto for retaining the conduits in the retrieval star wheel notched peripheries until they are discharged therefrom onto downstream inclined guideways 134. Upon reaching the end of guideways 134, each conduit interior is subjected to an air blast at one end thereof by means of air nozzle 136 which may be either continuously or intermittently operated, in the latter case, by means of any suitable switch device responsive to the successive positioning of a conduit adjacent the air nozzle. Liquid blown from the conduit interior is collected in a mist box 138 arranged at the opposite end of the conduit and from which liquid passes via drain 140 back into the treatment path.

A pair of vertically adjustable guide strips 142 are spaced slightly above the conduits on inclined guideways 134 to maintain the accumulated conduits in a single layer and thus prevent possible jamming of the apparatus which might be caused by a conduit riding up onto adjacently situated conduits and forming a second conduit layer. Similar guide strips are provided above the conduit on inclined guideways 120, however, for clarity, they have not been shown in FIG. 2. In addition, proximity switches may be mounted adjacent the input star wheels to sense correct alignment of the conduits entering the input star wheels and the switch outputs may be used to sound an alarm and/or interrupt the conveyor drive.

Shafts 112 and 122 are driven in synchronism with shaft 104, preferably by a sprocket and chain drive arrangement connected to shaft 104. Since the design and details of a synchronous device suitable for use with the present invention are considered to be within the capability of those skilled in the art, it will not be more specifically illustrated and described herein.

All conduit-contacting surfaces of the conveyor apparatus including the inclined guideways, star wheels, etc. are advantageously lined or coated with or fabricated from a polymer material to minimize abrasive contact with the conduit surfaces.

FIG. 3 illustrates the relationship between the conveyor 100 and a treatment tank 144, again with selected details of the apparatus omitted for clarity. As can be seen, the conduits C retained on the periphery of star wheels 102 are substantially horizontally disposed. It has been found in actual use of the apparatus according to the present invention that it is unnecessary for the purpose of rapidly purging air from the conduit interior to intentionally incline the conduit from the horizontal when immersed in the treatment bath as, for example, by inclining the shaft 104 or angularly offsetting the notches of star wheels 102. This is believed to be due, at least in part, to the relatively low viscosity of the cleaning, rinse and coating agents of the various baths, the relatively loose fit between the conduits and star wheel notches and the virtual impossibility of maintaining perfect horizontal alignment of the conduit immersed in the solution. FIG. 3 also shows more clearly the vertical offset between the axes of the different diameter retrieval star wheels 124, 126 which, together with the arcuate path traveled about such star wheels, provides the inclination necessary for effectively draining excess bath solution from the conduit surfaces.

Alignment guides 146 are affixed to opposite walls of tank 144 in confronting relation with the conduit ends over approximately the last 90° of arcuate travel of the conduit and serve to align conduits that may be longitudinally offset on star wheels 102.

FIGS. 4 and 5 illustrate details of the structure of input star wheels 114, each of which comprises a support plate 148 affixed to shaft 112 and having four radial arms 150 spaced 90° apart. The star wheel itself is defined by split plates **114*a* and 114*b* which are secured to the arms 150 of support plate 148 by bolts in the manner shown. The notches 116 of split plates 114*a*, 114*b* are designed to accommodate a given range of conduit diameters within the total range of conduit diameters which can be handled by the system. Thus, the split arrangement of plates 114*a*, 114*b* permits rapid changeover for different diameter conduits. Guide 118 (FIG. 5) is also provided with an insert 152 adapted for a particular range of conduit diameters and is likewise detachably secured to guide 118** by means of bolts or the like.

As best seen in FIG. 5, star wheel notches 116 are defined by an arcuate portion **116*a* which smoothly blends with a relatively straight portion 116*b*. Arcuate portion 116*a* is shaped in a manner to insure positive engagement of only a single conduit from guideway 120. Straight portion 116*b* cooperates with the conduit-contacting surface of insert 152 to discharge the conduit from star wheels 114 at a point directly above a single pair of aligned notches 108 in star wheels 102. Plates 114*a*, 114*b* and insert 152** are preferably formed of polymer materials, such as polyethylene or the like.

FIG. 6 illustrates the manner in which the conduits are removed from the immersion star wheels 102 by guide plates 132 and engaged by the retrieval star wheels 124, 126. As the star wheel 102 rotates counterclockwise, as shown by the arrow, conduits approaching the uppermost point thereof are engaged by an upwardly inclined portion 154 of guide 132 which urges the conduits upwardly into engagement with notches 128 of retrieval star wheel 124. The conduits are then conveyed in an arcuate path about star wheel 124, drained and discharged by gravity onto inclined guideway 134. Guide 132 is provided with guide elements 156, 158 secured on opposite sides thereof and which form the conduit-contacting surfaces of guide 132. Guide element 158 is provided with holes 160 and a slotted opening 162 by means of which its arcuate position on guide 132 can be adjusted to accommodate different diameter conduits.

FIG. 7 illustrates schematically the manner in which the rotary conveyor apparatus of the present system are controlled. The tank conveyors 200, 202, 204 are driven by motors 206, 208, 210 via gear reducers 212, 214, 216 respectively. For maximum system flexibility, each motor may be selectively either independently controlled by respective motor controls 218, 220, 222 or synchronously controlled by master motor control 224.

It can be seen from the foregoing that there is provided in accordance with this invention, an improved method and apparatus for the corrosion inhibiting treatment of tubular elements and, particularly, for cleaning and coating the interior and exterior surfaces of galvanized conduit issuing from a high-speed tube forming mill to prevent the formation of "white rust". The invention provides for minimum carry-over of treating agents between successive baths, thereby avoiding dilution and/or other chemical reactions which could alter the optimum bath conditions and reduce the effectiveness and economy of the coating process.

What is claimed is:

1. A method of continually treating the interior and exterior surfaces of tubular elements, comprising the steps of:

providing a first bath containing a cleaning agent, a second bath containing a rinsing agent, and a third bath containing a coating agent comprising an aqueous solution of a corrosion inhibitor and a film-forming polymer;

supplying a plurality of tubular elements comprising galvanized conduits of discrete length;

conveying said tubular elements in spaced, substantially parallel relation to each other about a first arcuate path through each bath in a first rotational direction for a predetermined immersion time;

conveying the tubular elements emerging from each bath about a second arcuate path disposed above each bath in a second rotational direction opposite to said first rotational direction; and simultaneously inclining said tubular elements in said second arcuate path, the inclination of said tubular elements and the path traveled by said tubular elements about said second arcuate path being effective to drain excess agent from said tubular elements and into the bath associated with said excess agent to thereby minimize the carry over of said agents between successive baths.

2. The method according to claim 1 wherein said cleaning agent comprises an alkaline aqueous solution of non-ionic surfactants.

3. The method according to claim 1 wherein said cleaning agent includes a biodegradable surfact and including the step of maintaining the pH of said cleaning agent in excess of about 9.

4. The method according to claim 2 including the step of maintaining the pH of said cleaning agent at a range from about 10.5 to about 11.5.

5. The method according to claim 2 including the step of maintaining the temperature of said cleaning agent from about 40° F to about 90° F.

6. The method according to claim 5 wherein the temperature is maintained between about 70° F to about 80° F.

7. The method according to claim 1 wherein said immersion time for said tubular elements in said cleansing agent ranges from about 0.5 minutes to about 5 minutes.

8. The method according to claim 7 wherein said immersion time for said tubular elements in said cleaning agent ranges from about 1 minutes to about 3 minutes.

9. The method according to claim 1 wherein said rinse agent comprises water.

10. The method according to claim 9 including the step of maintaining the temperature of said rinse agent from about 40° F to about 200° F.

11. The method according to claim 10 wherein the temperature of said rinse agent is maintained between about 160° to about 180° F.

12. The method according to claim 1 wherein said immersion time for said tubular elements in said rinse agent ranges from about 0.5 minutes to about 5 minutes.

13. The method according to claim 12 wherein said immersion time for said tubular elements in said rinse agent ranges from about 1 minute to about 3 minutes.

14. The method according to claim 1 wherein said coating agent is an alkaline aqueous solution 15. The method according to claim 14 wherein said corrosion inhibitor comprises chromate ions, said coating solution having a non-volatile content of about 1.0% by weight or more.

16. The method according to claim 15 including the step of maintaining the pH of said coating agent between about 7.8 to about 10.

17. The method according to claim 16 wherein the pH is automatically controlled between about 8.5 to about 9.

18. The method according to claim 14 including the step of maintaining the temperature of said coating agent fron about 100° F to about 140° F.

19. The method according to claim 18 including the step of maintaining the temperature of said coating agent from about 110° to about 135° F.

20. The method of according to claim 1 wherein said immersion time for said tubular elements in said coating agent ranges from about 0.5 minutes to about 5 minutes.

21. The method according to claim 20 wherein said immersion time for said tubular elements in said coating agent ranges from about 1 to about 3 minutes.

22. The method according to claim 1 including the steps of recirculating and filtering said cleaning, rinse and coating agents.

23. The method according to claim 1 including the step of air blasting the interior of said tubular elements after said tubular elements depart said second arcuate path.

24. The method according to claim 1 including the step of controlling the rotational speed of the tubular elements about the first arcuate path in one of said baths independently of that in another of said baths.

25. The method according to claim 1, including the step of accumulating said tubular elements prior to introduction into each of said baths.

26. The method according to claim 1, including the steps of conveying said tubular elements about a third arcuate path prior to the introduction of said tubular elements into said first arcuate path and introducing said tubular elements one-by-one into said first arcuate path.

27. The method according to claim 26 wherein the tubular elements are conveyed about said third arcuate path in a direction opposite to said first rotational direction.

28. The method according to claim 1 wherein said tubular elements are discrete lengths of interiorly and exteriorly galvanized conduit.

29. A method of continually treating the interior and exterior surfaces of tubular elements, comprising the steps of:

providing a first bath containing a cleaning agent, a second bath containing a rinse agent, and a third bath containing a coating agent comprising an aqueous solution of a corrosion inhibitor and a film forming polymer;

supplying a plurality of tubular elements comprising galvanized conduits of discrete length;

conveying said tubular elements in spaced, substantially parallel relation to each other about a first arcuate path through each bath in a first rotational direction for a predetermined immersion time;

conveying the tubular elements emerging from each bath about a second arcuate path disposed above each bath in a second rotational direction opposite to said first rotational direction;

substantially minimizing the carryover of said agents between successive baths by inclining said tubular elements in said second arcuate path, the inclination of said tubular elements and the path traveled by said tubular elements about said second arcuate path being effective to drain excess agent from the interior and exterior of said tubular elements and into the bath associated with said excess agent and by air blasting the interior of said tubular elements after said tubular elements depart the second arcuate path associated with said first and second baths.

30. The method according to claim 29 including the step of continuously overflowing said rinse agent from said second bath.

31. The method according to claim 29 including the step of drying said tubular elements emerging from said baths.

32. The method according to claim 29 including the step of spraying water on the exterior surfaces of said tubular elements emerging from said rinse agent.

33. The method according to claim 29, wherein said inclining step includes gradually increasing the inclination of said tubular elements from the horizontal to a maximum inclination and then gradually decreasing the inclination of said tubular elements.

* * * * *